US005295393A

United States Patent [19]

Thiercelin

[11] Patent Number: 5,295,393

[45] Date of Patent: Mar. 22, 1994

[54] FRACTURING METHOD AND APPARATUS

[75] Inventor: Marc J. Thiercelin, Cambridge, England

[73] Assignee: Schlumberger Technology Corporation, Houston, Tex.

[21] Appl. No.: 907,427

[22] Filed: Jul. 1, 1992

[30] Foreign Application Priority Data

Jul. 1, 1991 [GB] United Kingdom ..... 9114972

[51] Int. Cl.[5] ..... E21B 47/00

[52] U.S. Cl. ..... 73/155; 166/271

[58] Field of Search ..... 73/155, 784; 299/20, 299/21; 166/187, 191, 177, 271, 250, 308

[56] References Cited

U.S. PATENT DOCUMENTS

| | | | |
|---|---|---|---|
| 4,398,416 | 8/1983 | Nolte | 73/155 |
| 4,453,595 | 6/1984 | Lagus et al. | 73/155 |
| 4,635,719 | 1/1987 | Zoback et al. | 73/155 |
| 4,660,415 | 4/1987 | Bouteca | 73/155 |
| 4,665,984 | 5/1987 | Hayashi et al. | 166/308 |
| 4,836,280 | 6/1989 | Soliman | 160/250 |
| 4,860,581 | 8/1989 | Zimmerman et al. | 73/155 |
| 4,936,139 | 6/1990 | Zimmerman et al. | 73/155 |
| 4,986,120 | 1/1991 | Yanagisawa et al. | 73/155 |
| 5,165,276 | 11/1992 | Thiercelin | 73/155 |

FOREIGN PATENT DOCUMENTS

| | | |
|---|---|---|
| 0146324 | 6/1985 | European Pat. Off. . |
| 2060903 | 5/1981 | United Kingdom . |
| 2220686 | 1/1990 | United Kingdom . |

OTHER PUBLICATIONS

C. Ljunggren, O. Stephanson "Sleeve Fracturing—A borehole technique for in-situ determination of rock deformability and rock stress", *Proceedings of the International Symposium on Rock Stress and Rock Stress Measurements*, pp. 313-322 3 Sep. 1-3, 1986 / Stockholm.

*Primary Examiner*—Robert J. Warden
*Assistant Examiner*—Hien Tran
*Attorney, Agent, or Firm*—Wayne I. Kanak; John J. Ryberg

[57] ABSTRACT

A method of fracturing an underground formation traversed by a borehole comprising: a) placing an inflatable member inside the borehole in the formation to be fractured, b) inflating the member so as to exert stress on the formation while monitoring the pressure of a fluid used to inflate the member so as to determine the pressure at which fracture initiates; c) isolating the portion of the borehole containing the fracture; d) propagating the fracture by pressurizing the interval with fluid; and e) monitoring the pressure of the fluid in the interval during propagation.

14 Claims, 4 Drawing Sheets

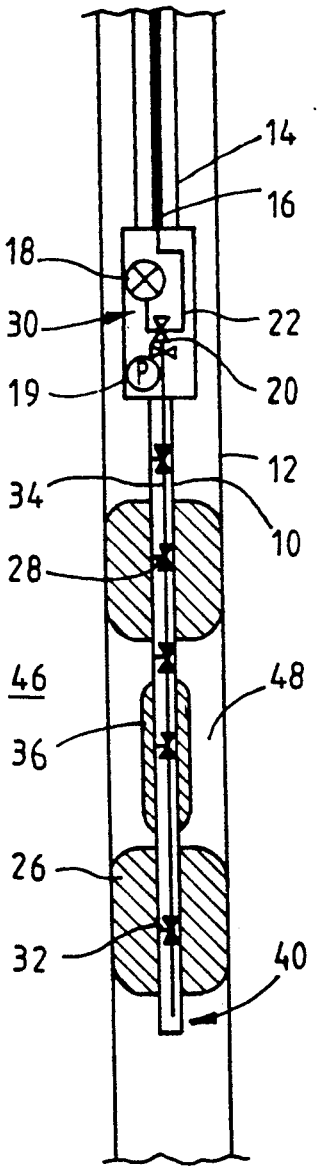
FIG. 1
FIG. 2A
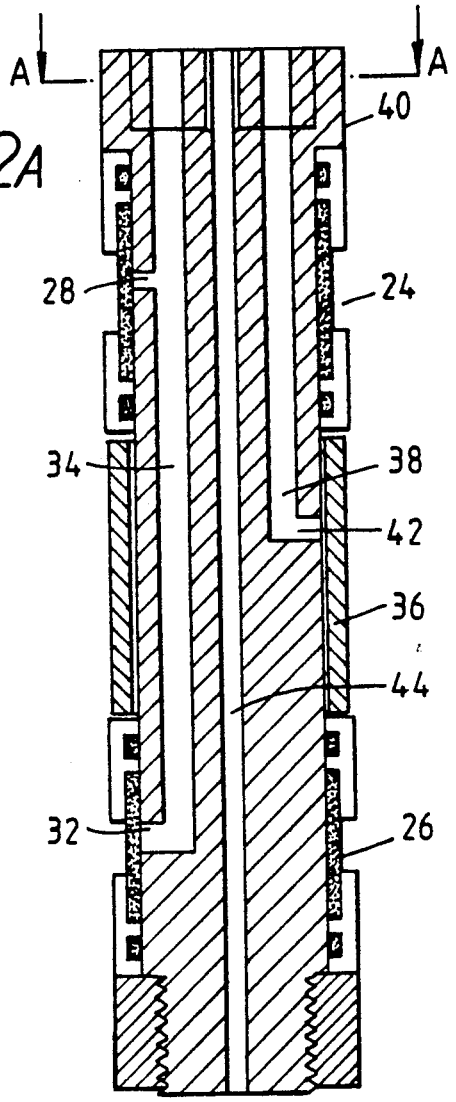
FIG. 2B
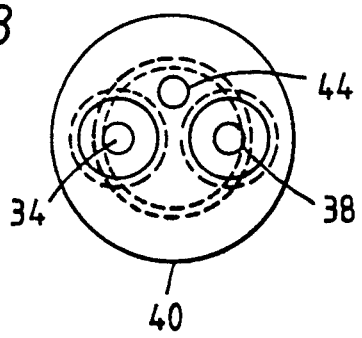

FRACTURING METHOD AND APPARATUS

The present invention relates to a method and apparatus which can be used to fracture an underground formation that is traversed by a borehole.

The mechanical properties of rocks are known to have great influence on the drilling of gas and oil wells and to many other aspects of well completion, stimulation and production. In view of this, various tests have been proposed to determine the mechanical properties and state of stress of formations that are traversed by a borehole. The principal methods used to date is known as microhydraulic fracturing. A description of this technique can be found in *Reservoir Stimulation* by Economides and Nolte published by Schlumberger Educational Service, 1987, pp 2-16–2-18.

In microhydraulic fracturing, a portion of an uncased or "open" borehole is isolated from the remainder of the borehole by means of inflatable packers. The packers are lowered into the well in a deflated state on the end of a tube line. When the appropriate position is reached, fluid is pumped into the tube line and inflates the packers to occupy the borehole and contact the borehole wall. The space between the packers is known as the test interval. The packers are formed from an elastic resilient material, usually rubber, and are inflated to a sufficient pressure to isolate the test interval from the remainder of the borehole. Once the test interval has been established, fracturing fluid is pumped from the surface into the test interval via the tubing line. The development of the pressure of the fracturing fluid is monitored during pumping in order to determine when the formation in the test interval fractures. At this point, known as breakdown, the pressure suddenly drops as the formation fractures and the fracturing fluid permeates the formation and propagates the fracture. After a short period of fracture propagation, once the pressure stabilizes pumping is stopped and the test interval shut-in. The pressure when the test interval is shut-in is taken and is known as the Instantaneous Shut-In Pressure. After a short period of shut-in, valves are opened which allows the fracturing fluid to flow out of the fracture and the test interval thus allowing the fracture to close. The cycle of pressurization is then repeated to find the re-opening pressure which is lower than the breakdown pressure by an amount known as the tensile strength of the formation.

The microhydraulic fracturing technique described above does, however, suffer from certain problems which can cause problems in obtaining useful results. Furthermore, the observed breakdown pressure is often significantly higher than the pressure required to propagate the fracture. Consequently, after breakdown the fracture can propagate a significant distance without any further pressurization taking place. Because the distance from the surface to the test interval and hence the length of the tube line can be several thousand feet such that, a significant amount of fracturing fluid must be used to pressurize the test interval and the tube line. However, some of the pressure detected at the surface will be due to compression of the fracturing fluid and deformation of the tube line and hence represents energy stored in the system. When a fracture initiates, this stored energy (pressure) will force fluid into the fracture causing unwanted propagation which might cause the fracture to propagate beyond the test interval causing communication between the test interval and the remainder of the well. This problem might also be encountered as a result of excessively high pumping rates where control of the pressure development in the test interval might be less accurate.

The use of packers to isolate the test interval can also cause problems as these can cause unwanted fracturing of the formation. In order to function effectively, the packers must exert sufficient pressure on the formation to seal the test interval despite the high pressure differential between the test interval and the remainder of the borehole that might be encountered during the fracturing operation. In so doing, the packers can themselves cause physical damage to the formation which means that the results of the fracturing test will be incorrect. Rocks that have a low shear strength will typically also suffer damage from the packers due to the difference in pressure encountered across the packer during fracturing. This can be reduced to some extent by using long packers.

It has been proposed previously to measure earth stresses in situ by inflating a resilient cylinder in a borehole to exert stresses on the formation, e.g. EP 0,146,324 A and Proceedings of the International Symposium on Rock Stress Measurement/Stockholm/Sep. 1-3, 1986, pp 323-330, C Ljunggren & O Stephansson. However, none of these techniques allow measurement of earth stresses by hydraulic fracturing within the influence of a test interval. It is the object of the present invention to provide a method and apparatus for performing fracturing tests which eliminate or mitigate the problems identified above.

In accordance with a first aspect of the present invention, there is provided a method of fracturing an underground formation traversed by a borehole comprising: a) placing an inflatable member inside the borehole in the formation to be fractured, b) inflating the member so as to exert stress on the formation while monitoring the pressure of a fluid used to inflate the member so as to determine the pressure at which fracture initiates; c) isolating the portion of the borehole containing the fracture; d) propagating the fracture by pressurizing the interval with fluid; and e) monitoring the pressure of the fluid in the interval during propagation.

In accordance with a second aspect of the present invention, there is provided apparatus for fracturing an underground formation traversed by a borehole comprising an inflatable member capable of being lowered into the borehole when deflated and equipped with means for admitting a pressurizing fluid from a supply line so as to inflate said member for fracturing the borehole wall, the supply line being provided with means for pumping the pressurizing fluid into the member, means for monitoring the pressure of said fluid in the member, means for isolating a portion of the borehole; and means for pumping fluid into said interval and means for removing fluid from said interval.

Preferably, the means for pumping the fluid is a downhole pump adjacent the inflatable member.

In one embodiment the apparatus comprises a pair of straddle packers, one located either side of the inflatable member, means being included for admitting fracturing fluid to a test interval defined by the straddle packers after inflation thereof and deflation of the member.

The downhole pump is conveniently arranged to pump the pressurizing or fracturing fluid both into and out of the member, straddle packers or test interval as appropriate.

BRIEF DESCRIPTION OF THE DRAWINGS

The present invention will now be described by way of example, with reference to the accompanying drawings, in which:

FIG. 1 shows a diagramatic representation of one embodiment of an apparatus according to the present invention;

FIG. 2A shows a longitudinal cross section of the lower tool part of FIG. 1;

FIG. 2B shows a transverse cross section on line A—A of FIG. 2A;

Referring now to FIGS. 1, 2A and 2B there is shown therein a schematic view of a tool 10 which is capable of being lowered into a wellbore 12 by means of a tubing line 14, typically coil tubing, with a wireline 16 contained therein for communication to and from the surface. The tool 10 can comprise a modular tool such as that described in U.S. Pat. Nos. 4,860,581 and 4,936,139 (incorporated herein by reference). The embodiment shown in FIGS. 1, 2A and 2B comprises a modified form of the packer module described in these patents. The tool 10 comprises an upper part 30 including a pump 18, a pressure gauge 19 and a valve arrangement 20. A series of fluid passages 22 are provided which communicate with the tubing 14 so as to allow fluid to be provided therefrom to the rest fo teh tool. The fluid passages 22 include a passage bypassing the pump 18 such that fluid can be pumped into the tool from the surface if required.

Figure 3:
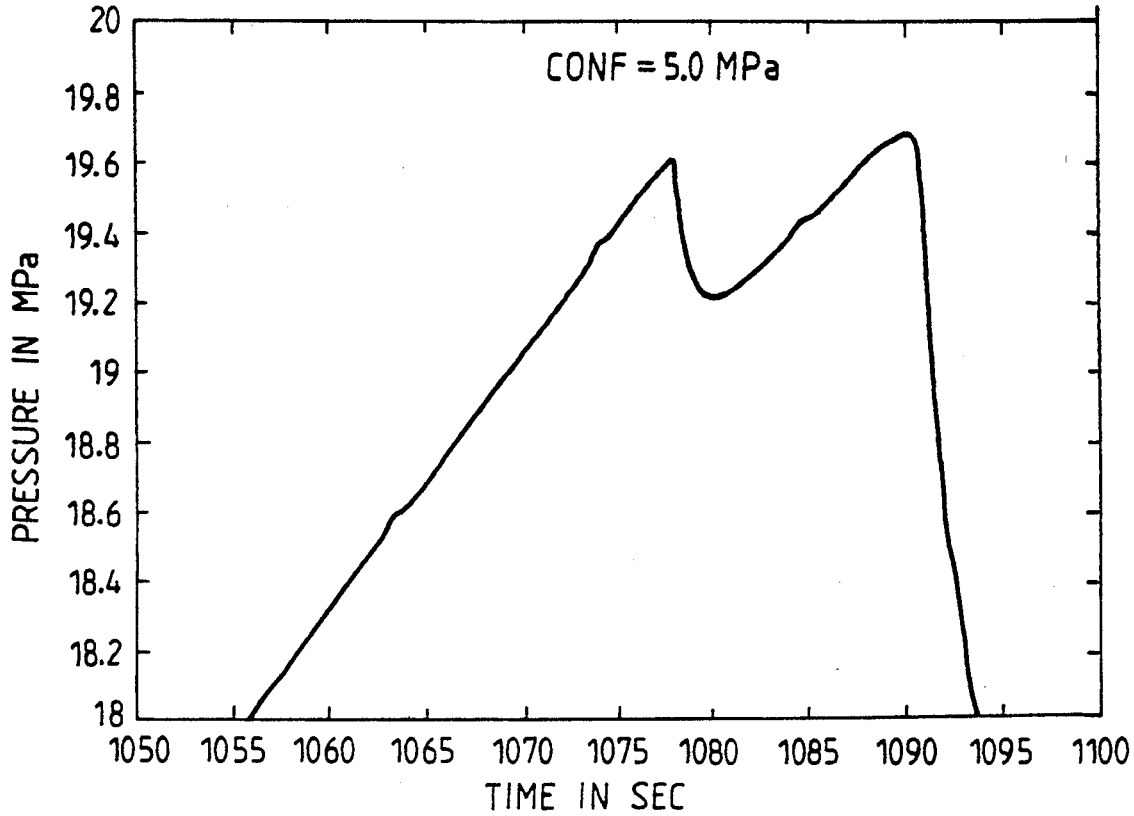
FIG. 3 shows a pressure vs time plot of a fracturing operation performed according to one embodiment of the method according to the present invention.

A fluid outlet from the upper part 30 connects to an elongate lower tool part 40 shown in detail in FIGS. 2A and 2B. The lower tool part 40 has a pair of straddle packers 24, 26 provided around an upper and lower region respectively. The packers 24, 26 are formed from a resilient, elastic material such as re-inforced rubber and are annular in shape surrounding the lower tool part 40. Each packer is inflatable and is connected by ports 28, 32 to a fluid passage 34 which is in turn connected to the upper tool part 30. Interposed between the packers 24, 26 and encircling the lower tool part 40 is a fracturing sleeve 36. The sleeve 36 is formed of rubber and is connected to its own fluid supply passage 38 by means of a port 42. A pressure equalizing passage 44 is provided through the lower tool part 40 so as to allow fluid communication in the borehole above and below the tool. A further port and passage (not shown) are provided to allow fluid to be pumped into the interval between the packers 24, 26 separately from that pumped into the sleeve 36. The valves and ports shown in the above referenced patents are modified to eanble the packers and sleeve to be inflated and deflated as required and the test interval to be pressurised and depressurised. The pressure in the sleeve and test interval can be measured with the pressure measurement device described in these patents.

In use, the tool 10 is lowered with the packers 24, 26 and sleeve 36 deflated into the wellbore 12 until the formation to be investigated 46 is reached. At this point the pump 18 and valve arrangement 20 are operated to pump fluid from the tubing 14 into the sleeve 36. This has the effect of inflating the sleeve 36 until it occupies the whole of that portion of the wellbore and contacts the formation 46. Pumping of fluid continues, the pressure being monitored continuously by the pressure gauge 19 and the information being transmitted to the operator at the surface via the wireline 16. At a certain pressure dependent upon the lithology, the formation fractures and the pressure in the sleeve 36 drops as the fracture propagates initially. Further propagation can be effected by increasing the pressure in the sleeve 36. A pressure vs time plot of this operation can be seen in FIG. 3, the formation in this case comprising marble. In this example the fracture initiates at 19.6 MPa at which point the pressure drops to a minimum of 19.2 MPa. This can be used to determine the rock fracture toughness and shows that once the fracture is long enough (about 30% of the well radius), the pressure must be increased to obtain further propagation. The sleeve is deflated at 1090 s.

Figure 4:
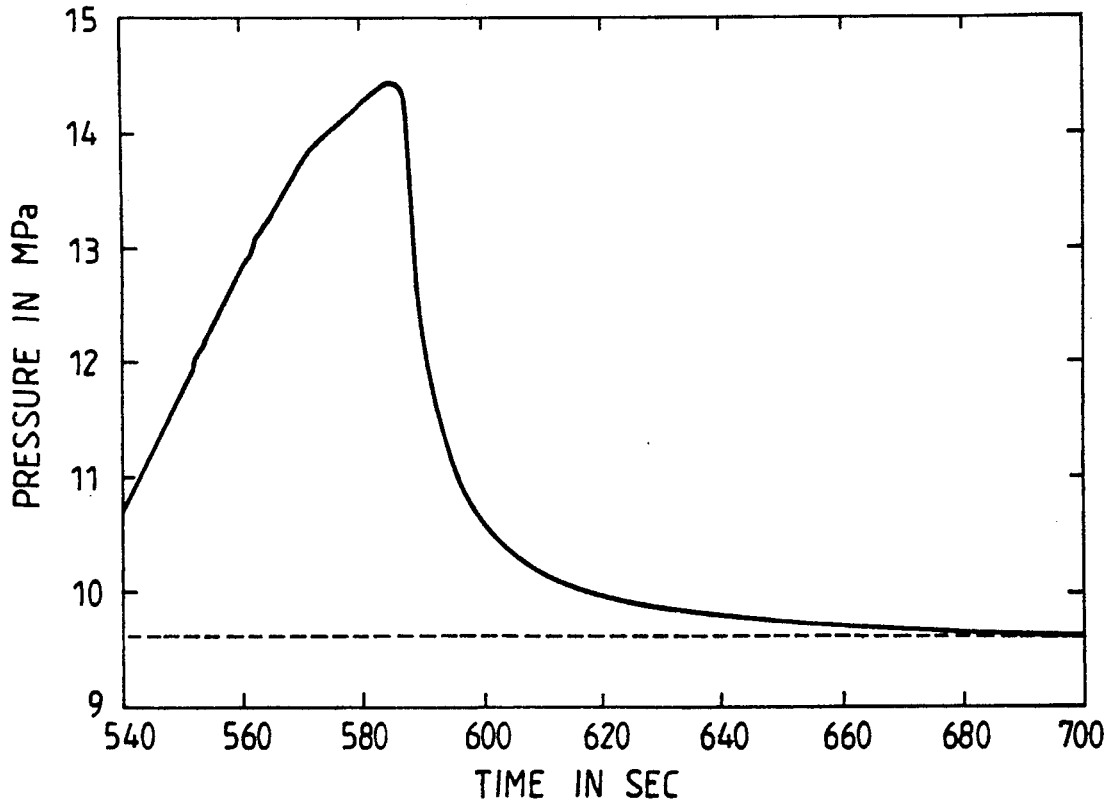
FIG. 4 shows a pressure vs time plot for a hydraulic fracturing test performed after the fracturing operation shown in FIG. 3.

Once the sleeve 36 is deflated, the packers are inflated by adjustment of the valves 20 and further pumping. The pressure that the packers must achieve can be inferred from the sleeve fracturing as a further hydraulic fracture test will generally be conducted at a much lower pressure than the sleeve fracture initiation pressure. Once the packers 24, 26 are inflated and the test interval 48 established fluid can be pumped into the interval and a fracture test performed. FIG. 4 shows the pressure vs time plot from such a fracture test. The confining pressure, i.e. the pressure in the packers is shown as the dashed line is steady at about 9.5 MPa. In this case the maximum pressure encountered in the test interval is about 14.5 MPa whereas without the pre-induced fracture a pressure of the order of 40 MPa would be encountered. Thus a reduction in the breakdown pressure of more than 60% has been achieved.

Figure 5:
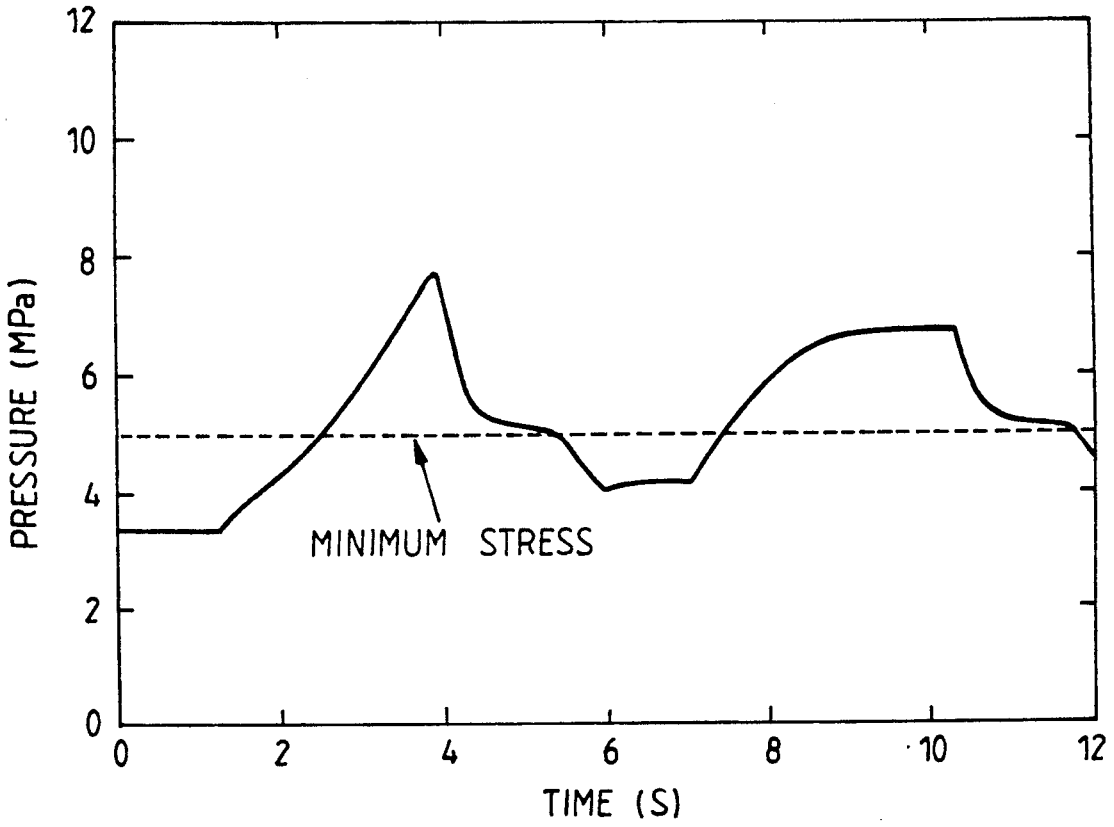
FIG. 5 shows a pressure vs time plot of a fracturing operation performed after the fracturing shown in FIG. 3 and in accordance with the method described in U.S. Pat. No. 5,165,276.
Figure 6:
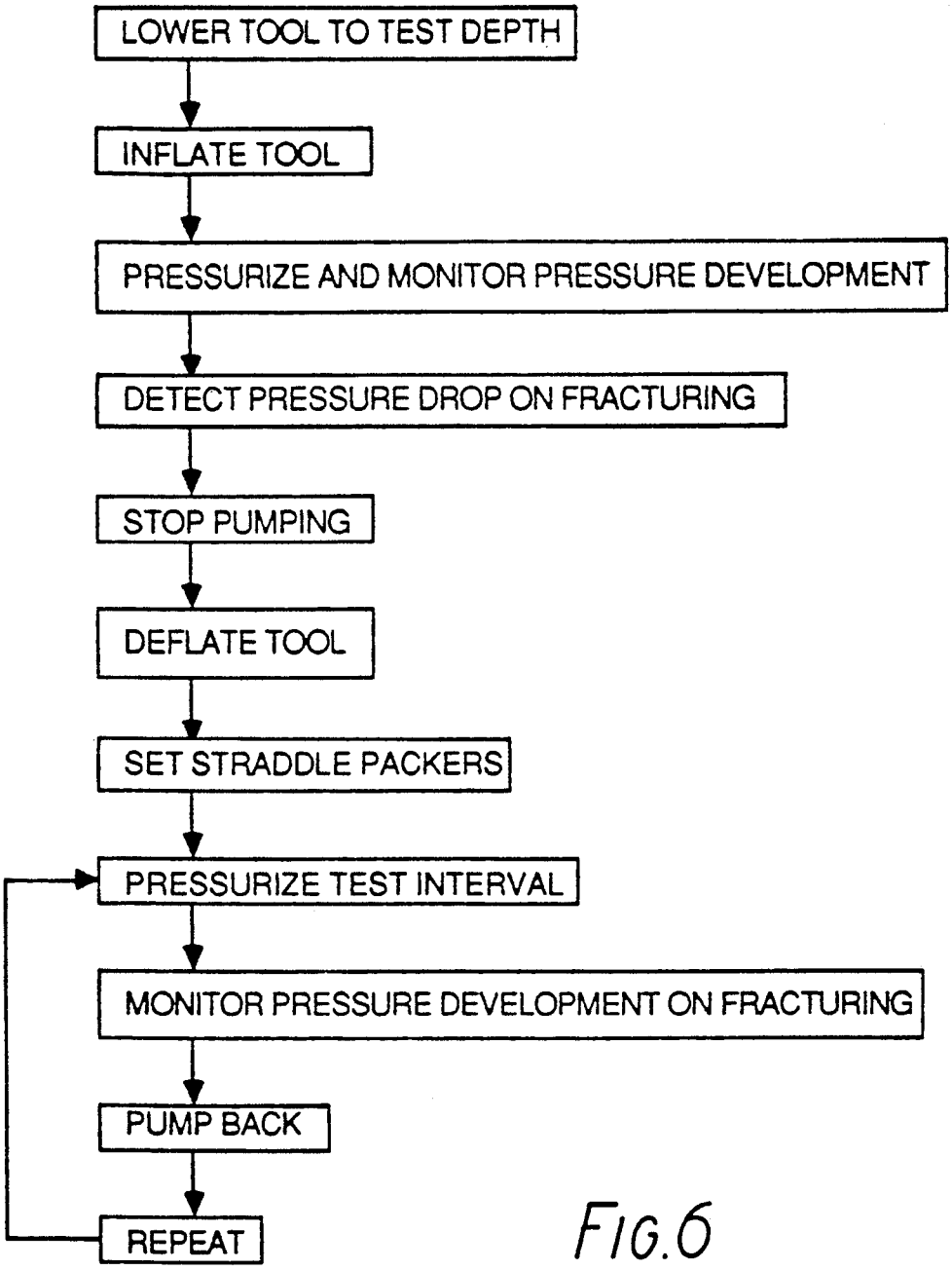
FIG. 6 shows a flow chart of the method according to the present invention.

While FIG. 4 represents a standard microhydraulic fracture test a further method of conducting a fracture test can be applied according to the method described in U.S. Pat. No. 5,165,276. In this case, at breakdown the pump is reversed to pump fluid out of the test interval to prevent fracture propagation. After the closure of the fracture is observed, the interval is repressurised and the process repeated. The plot of pressure vs time in this case can be used to determine the minimum stress ($\sigma^3$) of the formation. FIG. 5 shows the pressure vs time plot for such a test in a shale and the flow chart in FIG. 6 described the method of the present invention in conjunction with this technique.

The tool and technique described herein has various advantages above and beyond those already highlighted. The provision of a downhole pump allows much more accurate control of pumping rates, typically in the range of 0.01–1 Gallon/minute, as required for the method of U.S. Pat. No. 5,165,276. The surface pumps can provide flow rates up to 50 Gallon/minute if required.

The sleeve fracture packer does not have to seal the formation and will not support any shear stress. This means, for example, that the rubber thickness could be much less for the sleeve-fracturing packer than the one uses for the straddle packer. Smaller rubber thickness will produce stronger packers which is particularly needed for this packer which will have to sustain high differential pressure. The sleeve fracturing technique will be particularly efficient in strong rocks (tight gas sandstones, siltstones, low permeability limestones) due to the high breakdown pressures which could be expected in these rocks, and in very soft formations (shales) which cannot support the shear stress which are imposed by the straddle packers during an hydraulic fracturing test. The present invention has the following advantages: it imposes a location and orientation on the fracture, it reduces significantly the breakdown pressure for the hydraulic fracturing operation such that the hydraulic fracture will initiate and propagate prior to damage occurring at the straddle packers, and there is low energy storage in the fluid in the system so allowing better control.

The pressure response of the sleeve fracturing technique can be used to determine the elastic modulus and fracture toughness (A S Abuu-Sayed, *An Experimental Technique for Measuring the Fracture Toughness of Rocks under Downhole Stress Conditions VDi*-Berichte Nr 313, 1978) and state of stress. Furthermore fracture length and stress concentration can be extracted from these results.

It is not essential to use the apparatus described above and it may be required to mount the fracturing sleeve separately from the packers, either on the same tool or on a different tool. However, the placement of the straddle packers must be achieved accurately in this case.

In an alternative embodiment of the invention, the initial fracturing can be performed by one of the straddle packers after which the tool is repositioned and both straddle packers inflated to isolate the test interval. In this case, the inflatable sleeve is not required and can be omitted from the tool.

I claim:

1. A method of fracturing an underground formation traversed by a borehole, the method comprising:

a) suspending a fracturing apparatus in a borehole so as to position an inflatable member on said fracturing apparatus adjacent to an underground formation to be fractured;

b) inflating the inflatable member with a pressurizing fluid so as to contact the underground formation and exert stress thereon;

c) increasing the pressure of the pressurizing fluid in the inflatable member until a fracture is initiated in the underground formation;

d) monitoring the pressure of the pressurizing fluid in the inflatable member so as to determine the pressure at which the fracture is initiated;

e) isolating an interval of the borehole containing the fracture;

f) further fracturing the underground formation by pumping a fracturing fluid into the interval; and g) monitoring the pressure of fracturing fluid pumped into the interval during the further fracturing.

2. A method as claimed in claim 1, wherein the underground formation to be fractured resides in a section of uncased hole.

3. A method as claimed in claim 1, comprising decreasing the pressure of the pressurizing fluid in the inflatable member after a fracture has been detected.

4. A method as claimed in claim 1, wherein the further fracturing includes the step of removing fracturing fluid from the interval as soon as fracture propagation is observed.

5. A method as claimed in claim 1, wherein the inflatable member comprises one of a pair of straddle packers which serve to isolate the interval, the method comprising fracturing the formation with said one of said pair of straddle packers followed by positioning said pair of straddle packers so as to isolate the interval of the borehole containing the fracture by inflating both packers.

6. Apparatus to be lowered into a borehole for fracturing an underground formation traversed by said borehole, the apparatus comprising;

a) an inflatable member which is deflated when the apparatus is lowered into a borehole;

b) means for pumping a pressurizing fluid from a supply line into the inflatable member so as to inflate the inflatable member and exert stress on, and fracture an underground formation;

c) means for monitoring the pressure of the pressurizing fluid in the inflatable member;

d) means for isolating an interval of the borehole including a fracture created by inflation of the inflatable member;

e) means for pumping fracturing fluid into and out of the interval.

7. Apparatus as claimed in claim 6, wherein the means for pumping the pressurizing fluid is a downhole pump adjacent to the inflatable member.

8. Apparatus as claimed in claim 6, wherein the means for isolating an interval of the borehole comprises a pair of straddle packers, one of said pair of straddle packers located either side of the inflatable member, means being included for admitting fracturing fluid to the interval defined by the pair of straddle packers after inflation thereof and deflation of the inflatable member.

9. Apparatus as claimed in claim 8, wherein a downhole pump is provided to pump fluid into and out of any of the inflatable member, the pair of straddle packers and the interval.

10. A method of fracturing an underground formation traversed by a borehole comprising providing an apparatus having: a) an inflatable member which is lowered into a borehole when deflated and equipped with means for admitting a pressurizing fluid from a supply line so as to inflate said member for fracturing a borehole wall, the supply line being provided with means for pumping the pressurizing fluid into the member; b) means for monitoring the pressure of said pressurizing fluid in the member; c) means for isolating an interval of the borehole; d) means for pumping fracturing fluid into said interval; and e) means for removing fracturing fluid from said interval, said method further comprising: i) placing said apparatus inside the borehole in the underground formation to be fractured, ii) inflating the inflatable member with the pressurizing fluid so as to exert stress on, and fracture the underground formation while monitoring the pressure of the pressurizing fluid used to inflate the member so as to determine the pressure at which fracture initiates; iii) isolating an interval of the borehole containing the fracture; iv) propagating the fracture by pumping a fracturing fluid into the interval; and v) monitoring the pressure of the fracturing fluid in the interval during the fracture propagation.

11. A method as claimed in claim 10, wherein the underground formation to be fractured resides in a section of uncased hole.

12. A method as claimed in claim 10, comprising decreasing the pressure of the pressurizing fluid in the inflatable member after a fracture has been detected.

13. A method as claimed in claim 10, wherein the fracture propagation includes the step of removing fracturing fluid from the interval as soon as fracture propagation is observed.

14. A method as claimed in claim 10, wherein the inflatable member comprises one of a pair of straddle packers which together serve to isolate the interval containing the fracture, the method comprising fracturing the formation with said one of a pair of straddle packers followed by positioning said pair of straddle packers so as to isolate the interval of the borehole containing the fracture by inflating both packers.

* * * * *